US007544076B2

(12) United States Patent
Lubkert

(10) Patent No.: US 7,544,076 B2
(45) **Date of Patent: *Jun. 9, 2009**

(54) CIRCUIT SELECTABLE RECEPTACLE

(75) Inventor: Kenneth H. Lubkert, Fort Wayne, IN (US)

(73) Assignee: Group Dekko, Inc., Kendallville, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/871,202

(22) Filed: Oct. 12, 2007

(65) Prior Publication Data

US 2008/0026621 A1 Jan. 31, 2008

Related U.S. Application Data

(62) Division of application No. 11/439,057, filed on May 23, 2006, now Pat. No. 7,303,417.

(51) Int. Cl.
*H01R 4/60* (2006.01)

(52) U.S. Cl. ..... 439/215

(58) Field of Classification Search ..... 439/215, 439/189, 511, 49

See application file for complete search history.

(56) References Cited

U.S. PATENT DOCUMENTS 4,056,297 A * 11/1977 Gartung ..... 439/215
4,367,370 A 1/1983 Wilson et al.
4,377,724 A 3/1983 Wilson
4,740,167 A * 4/1988 Millhimes et al. ..... 439/92
4,781,609 A 11/1988 Wilson et al.
5,087,207 A 2/1992 Byrne
5,092,787 A 3/1992 Wise et al.
5,096,431 A 3/1992 Byrne
5,131,860 A * 7/1992 Bogiel ..... 439/215
5,236,370 A 8/1993 King et al.
5,252,086 A * 10/1993 Russell et al. ..... 439/215
5,503,565 A 4/1996 McCoy
5,964,610 A 10/1999 McCoy
6,123,562 A 9/2000 King et al.
6,431,894 B1 8/2002 Boiret et al.
6,948,962 B1 9/2005 DeYoung et al.
7,108,532 B2 9/2006 Lubkert
7,303,417 B2 12/2007 Lubkert

* cited by examiner

*Primary Examiner*—Phuong K Dinh
(74) *Attorney, Agent, or Firm*—Taylor & Aust, P.C.

(57) ABSTRACT

A distribution harness for use in a modular furniture environment, the distribution harness including a harness connector and an electrical receptacle connected to the harness connector, the electrical receptacle including a connector having a plurality of connector terminals, a plurality of receptacle terminals, and at least one jumper providing connection from one of the plurality of receptacle terminals to one of the plurality of connector terminals.

12 Claims, 3 Drawing Sheets

CIRCUIT SELECTABLE RECEPTACLE

CROSS REFERENCE TO RELATED APPLICATIONS

This is a divisional application based upon U.S. continuation patent application Ser. No. 11/439,057, entitled "CIRCUIT SELECTABLE RECEPTACLE", filed May 23, 2006 now U.S. Pat. No. 7,303,417, which is based upon U.S. non provisional patent application Ser. No. 10/776,963, entitled "CIRCUIT SELECTABLE RECEPTACLE", filed Feb. 11, 2004, which is based upon U.S. provisional patent application Ser. No. 60/446,611, entitled "CIRCUIT SELECTABLE RECEPTACLE", filed Feb. 11, 2003.

BACKGROUND OF THE INVENTION

1. Field of the Invention

The present invention relates to modular office furniture, and, more particularly, to an electrical receptacle within a modular office furniture environment.

2. Description of the Related Art

Modular wall panel systems are used extensively in commercial and industrial settings to define workspace, provide privacy, control traffic flow, and minimize noise. Wall panel systems can also provide suitable structures for use with desks, tables, shelves, trays and the like as well as with other furniture, components, equipment and material such as may be used in a commercial or industrial setting. In addition, wall panel systems can be advantageously integrated into the design and decoration of a commercial or industrial setting.

Wall panel systems may include individual wall panel units of various types and sizes. Wall panel units may be full height floor-to-ceiling walls or may be walls of less than floor-to ceiling height, or may include a combination of such walls of varying heights. Wall panel units may totally enclose or only partially enclose specific areas depending upon the particular needs of the site. An advantage of wall panel systems of this type is that they can be reconfigured relatively easily compared to permanent wall structures (such as studs and drywall, plaster, or concrete).

In using wall panel systems, it is essential to provide electricity to workstations located in and around the wall panel units. Present demands for electrical power consumption may require the provision of several circuits through a wall panel system. Present demands may even require the use of one or more isolated circuits that do not share a neutral or ground wire with other circuits in order to minimize electrical interference that might cause problems for computer or communication systems. Accordingly, it is desirable that an electric distribution system be provided with the wall panel system that is easy to install yet provides a high level of electrical service.

Related to the feature of ease of installation is reconfigurability. Wall panel systems may be preferred over permanent wall structures because of the relative ease with which such systems can be reconfigured to adapt to the needs of a changing or expanding business. In particular, where a wall panel system is of high quality and durable, it is possible that at some point during the use of the wall panel system, the user's need will change and a reconfiguration of the wall panel system will be desired. In such a case, it is advantageous to have an electrical distribution system that can also be easily reconnected and reconfigured at the user's site either in the event of a reconfiguration of the wall panel system or in order to provide a different level of electric service to an existing wall panel system.

These office furniture units preferably include an electrical power distribution system of some type. Such power distribution systems preferably provide electrical power to the various workstations for typewriters, computers, dictating equipment, lights, clocks and other electrical appliances while still retaining flexibility in the arrangement of the furniture units. To facilitate this electrification, many furniture units include a utility raceway associated therewith in which a wiring system is housed.

Different types of electrical distribution systems are provided for use with wall panel units. One wall panel system that includes an electrical distribution system that provides electrical receptacles at the lower bottom, corners, near vertical midway and at other places of the wall panels, however these receptacles are not always conveniently located. Power receptacles may not be available as electrical and electronic devices are added, simply due to all available existing receptacles being used, among other reasons.

A wide variety of wiring systems for office furniture units are currently available. These wiring systems employ different techniques and arrangements to conduct electrical power through office furniture units and interconnect adjacent office furniture units. Versatility, durability, electrical integrity, convenience of installation, convenience in rearranging furnished units and overall safety are all important design considerations for these power distribution systems.

It is also desirable to provide a versatile power distribution system which incorporates convenience in connecting power outlets associated therewith to different power supplies. It is further desired that such distribution system fit within the limited confines of existing furniture units.

A raceway can include multiple conductors, for example eight conductors (three hot, three neutral and two ground), corresponding to multiple power circuits. These eight conductors can be terminated into a connector with eight terminals, for example. Another known modular power system is a distribution harness within the raceway that has a distribution connector connectable to multiple modular receptacles. Modular receptacles are known which include at least one connector that connects with the corresponding raceway or distribution harness connector. Since the duplex receptacle requires connection to only a single hot, a single neutral and a single ground, the receptacle connector will only have three terminals positioned in its connector to select one of the raceway power circuits.

A problem with this type of modular receptacle is that, because of the fixed terminals in its connector, the modular receptacle can only be connected to one of the power circuits in the raceway. As the modular office is reconfigured, or power needs change in other ways such as by the addition of power consuming equipment, it may be necessary to connect existing or new modular receptacles into other power circuits. An existing modular receptacle as previously discussed is limited to the power circuit selected by the location of the terminals in the receptacle connector. New modular receptacles can be added to any circuit, however, in the example described above, three different modular receptacles corresponding to the three different raceway power circuits, are required to be manufactured and stocked. As more circuits are added to the raceway more corresponding receptacles are required to be manufactured and stocked.

What is needed in the art is a single modular receptacle that can be configured and reconfigured to connect to any one of multiple power circuits in a modular furniture raceway.

SUMMARY OF THE INVENTION

The present invention provides a circuit selectable modular receptacle that is easily configurable and reconfigurable to connect to any one of multiple power circuits in a modular furniture raceway.

The invention comprises, in one form thereof, a modular wall panel assembly for use in a modular furniture environment including a modular wall panel and an electrical receptacle connected to the modular wall panel. The electrical receptacle includes a connector having a plurality of connector terminals, a plurality of receptacle terminals, and at least one jumper which connects one of the plurality of receptacle terminals to one of the plurality of connector terminals.

An advantage of the present invention is a circuit selectable receptacle that is configurable and reconfigurable to connect to any one of multiple power circuits in a modular furniture raceway.

Another advantage is a single modular receptacle can be manufactured to connect to multiple circuits thereby improving manufacturing efficiencies.

Yet another advantage is a single modular receptacle can be stocked, by the manufacture or end user, to connect to multiple circuits thereby reducing inventory costs.

A further advantage is the present invention enhances the flexibility of a modular furniture system.

A yet further advantage is the circuit selectable receptacle of the present invention can be used to optimize power circuits within a modular wall panel assembly.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
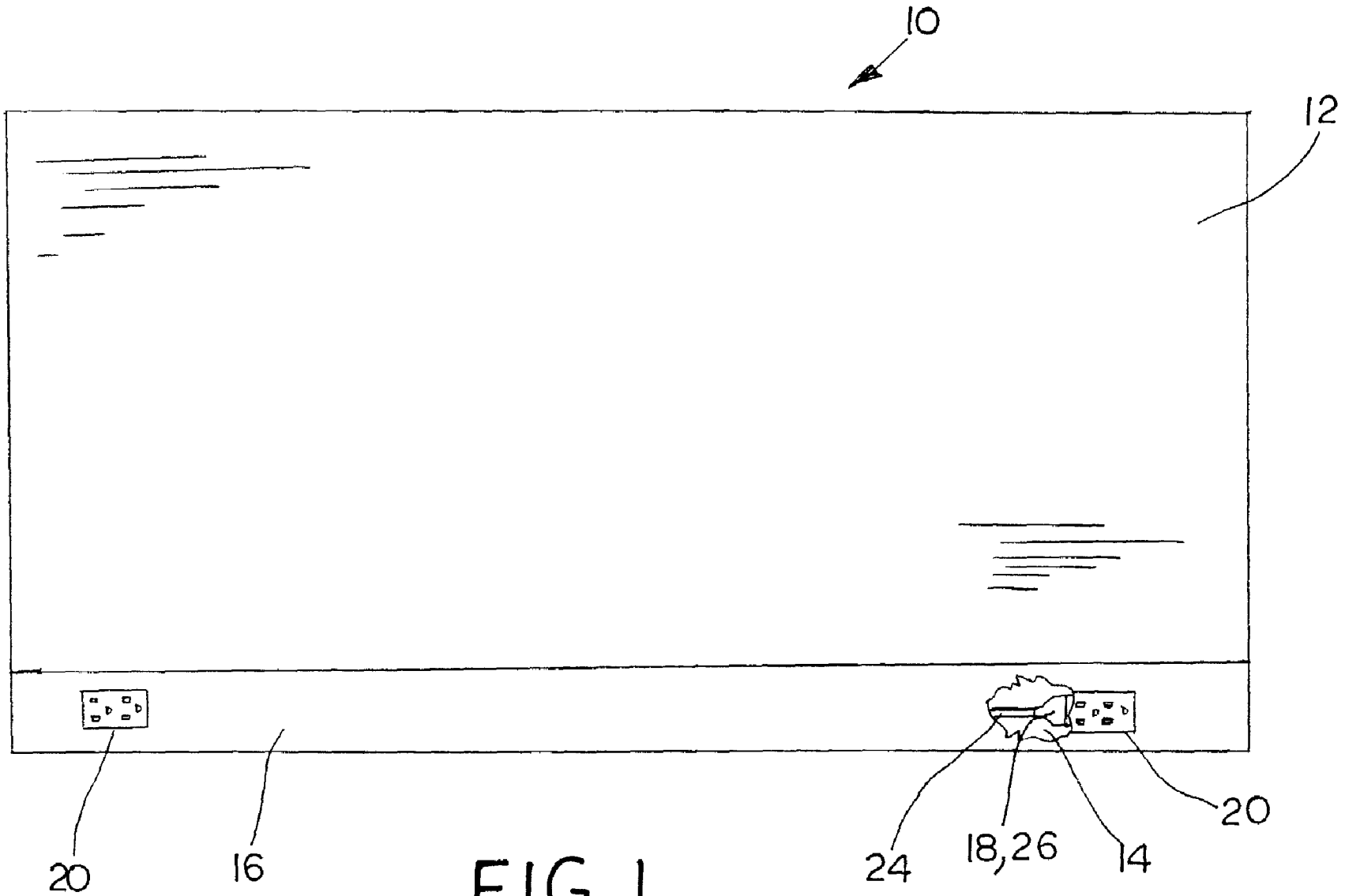
FIG. 1 is a partially fragmentary front view of an embodiment of a modular wall panel assembly of the present invention.

Referring now to the drawings, and more particularly to FIG. 1, there is shown a modular wall panel assembly 10 for use in a modular furniture environment which generally includes a modular wall panel 12, a raceway 14, a cover 16, a jumper cable 18 and at least one electrical receptacle 20.

Figure 4:
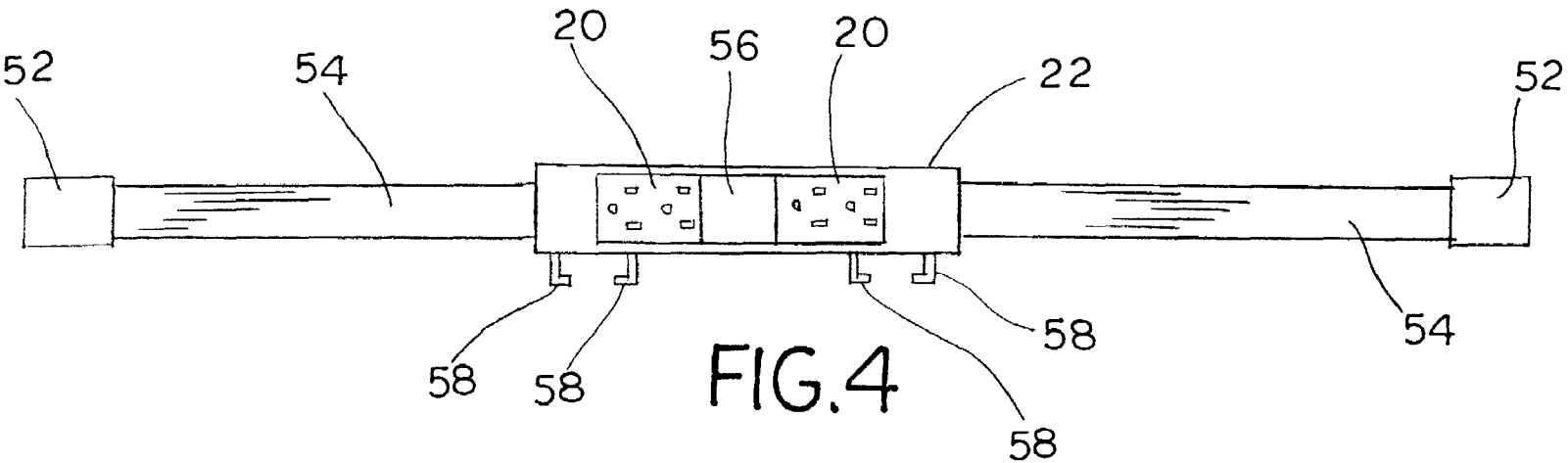
FIG. 4 is a front view of an embodiment of a distribution harness of the present invention with two circuit selectable receptacles connected to a harness distribution connector.

Jumper cable 18 is connected to, and provides a power infeed for, electrical receptacle 20. Jumper cable 18 can be connected to a source of electrical power (not shown). Connection of jumper cable 18 and electrical receptacle 20 is typically within raceway 14. Access to electrical receptacle 20 is provided by a cutout in cover 16. Electrical receptacle 20 is typically connected a frame component (not shown) in modular wall panel 12 and can contact cover 16. Alternatively, electrical receptacle 20 is connected to distribution harness 22 (FIG. 4) which is connected to a frame component (not shown) in modular wall panel 12.

Jumper cable 18 can include cable 24 with a plurality of conductors (not shown) terminating in cable connector 26. Cable connector 26 includes a plurality of cable connector terminals 28 connected to the corresponding cable conductors. For example, jumper cable 18 can include ten conductors corresponding to four hot, four neutral and two ground, or in other words four power circuits.

Electrical receptacle 20 (FIG. 2) includes at least one connector 30 which has a plurality of connector terminals 32, a plurality of receptacle terminals 34, and at least one jumper 36 which provides connection from one of receptacle terminals 34 to one of connector terminals 32. Only one receptacle terminal 34 is shown, however, electrical receptacle 20 typically has at least three receptacle terminals 34 corresponding to the hot, neutral and ground connections. When cable connector 26 is connected to connector 30 of electrical receptacle 20 each of cable connector terminals 28 is electrically connected to a corresponding connector terminal 32. Jumpers 36 selects which receptacle terminal 34 is electrically connected to a corresponding connector terminals 32, and thereby selects which receptacle terminal 34 is electrically connected to a corresponding cable connector terminal 28. In this way, a single electrical receptacle 20 can be connected to any of four power infeed circuits, for example, provided by jumper cable 18. Electrical receptacle 20 can have a single connector 30, or two connectors 30 or a single connector 30 and another connector to pass through electrical connection to another cable 18. Two connectors 30 requires additional jumpers 36 (not shown).

Figure 2:
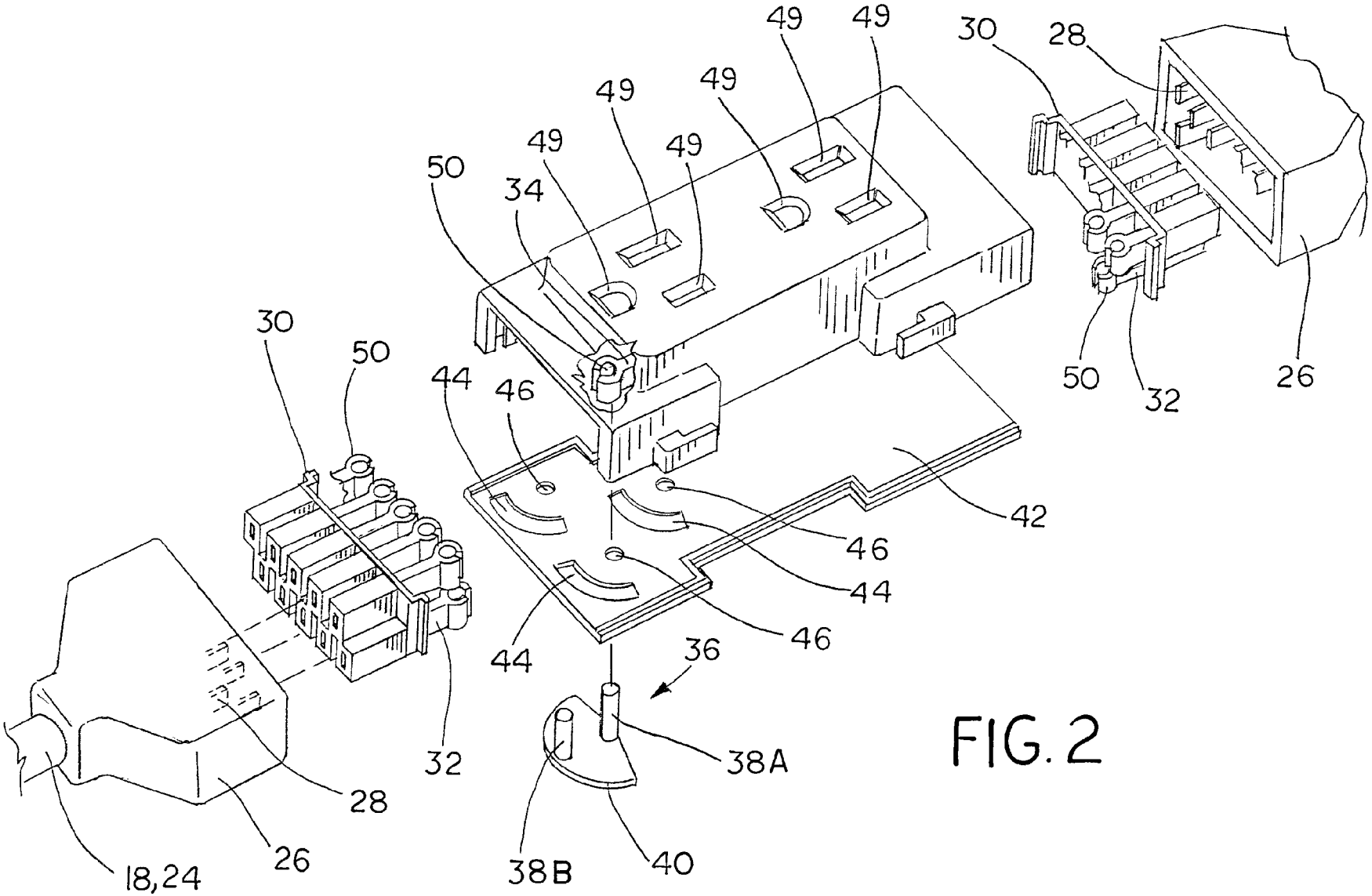
FIG. 2 is an exploded partially fragmentary perspective view of an embodiment of a circuit selectable receptacle of the present invention.
Figure 3:
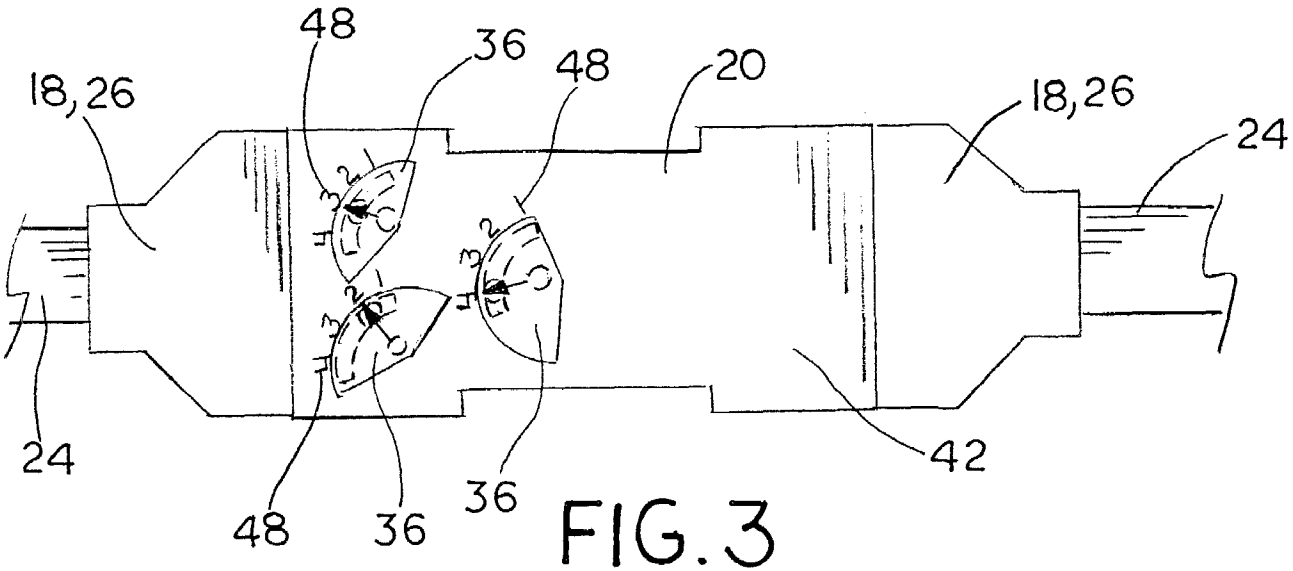
FIG. 3 is a back view of the circuit selectable receptacle of FIG. 2 shown assembled and connected to jumper connectors.

Jumper 36 can include jumper terminals 38A, 38B which are electrically connected. Jumper plate 40 can be of an insulative material. Although only one jumper 36 is shown in FIG. 2, multiple jumpers 36 can be provided, as shown in FIG. 3, to provide selection of each of the hot, neutral and ground receptacle terminals 34 in electrical receptacle 20 as dictated by the design of electrical receptacle 20.

Backplate 42 of electrical receptacle 20 can include arc openings 44 and jumper holes 46. One jumper terminal 38A is positioned in jumper hole 46 and the other jumper terminal 38B is positioned in arc openings 44. Jumper terminal 38B of jumper 36 is movable in arc opening 44 to select one of connector terminals 32 to be connected to a corresponding receptacle terminal 34. An indicia 48 on electrical receptacle 20 indicates which one of the plurality of connector terminals 32 are connected to a corresponding receptacle terminals 34. Indicia 48 can include, for example, numerals on backplate 42 and an arrow on jumper 36 to indicate which circuit has been selected. The insulative qualities of jumper plate 40 protects the live conductors within electrical receptacle 20. Connector terminals 32 can be staggered to follow the contour of arc openings 44. Electrical receptacle 20 includes receptacle openings 49 to allow plug insertion of an electrical appliance (not shown). Jumper 36 can be on a side of electrical receptacle 20 opposite receptacle openings 49, such as backplate 42.

At least one of connector terminals 32 can include a resilient arc 50 and a jumper terminal 38 can be received in resilient arc 50. Similarly, at least one of receptacle terminal 32 can include a resilient arc 50 and a jumper terminal 38 can be received in resilient arc 50.

At least one jumper 36 can be power infeed to receptacle terminals 32. Jumper cable 18 can be a power infeed to electrical receptacle 20.

Distribution harness 22 can include end connectors 52 which connect to a source of electrical power. Harness cables 54 connect conductors (not shown) from end connectors 52 to distribution connector 56. Electrical receptacle or receptacles 20 connect to distribution connector 56 and is thereby connected to a source of electrical power. Therefor distribution harness 22 can provide a power infeed to electrical receptacle 20. Distribution harness 22 can include feet 58 to connect to a frame of modular wall panel assembly 10.

In use, electrical receptacle 20 is provided which includes connector 30 that has a plurality of connector terminals 32, a plurality of receptacle terminals 34 and at least one jumper 36. At least one jumper 36 is inserted into electrical receptacle 20 and one of receptacle terminals 34 is connected to one of connector terminals 32 using jumper 36. A single electrical receptacle 20 can connect into any one of a plurality of circuits in a raceway. Electrical receptacle 20 can be easily reconfigured to adapt to a different circuit as needs change. Jumper 36 can be rotated in an arc 44 to connect one of receptacle terminals 34 to one of connector terminals 32. Indicia 48 indicates which one of connector terminals 32 are connected to a corresponding receptacle terminal 34.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A distribution harness for use in a modular furniture environment, comprising:

a harness connector; and an electrical receptacle connected to said harness connector, said electrical receptacle including a connector having a plurality of connector terminals, a plurality of receptacle terminals, and at least one jumper providing connection from one of said plurality of receptacle terminals to one of said plurality of connector terminals, further including an arc shaped opening in said electrical receptacle, said at least one jumper including a jumper terminal which is positionable in said arc opening.

2. The distribution harness of claim 1, wherein said connection of one of said plurality of receptacle terminals to one of said plurality of connector terminals is selectable by a placement of said jumper.

3. The distribution harness of claim 1, wherein said jumper terminal is movable in said arc opening.

4. The distribution harness of claim 1, further including an indicia on said electrical receptacle indicating one of said plurality of connector terminals being connected to one of said plurality of receptacle terminals.

5. The distribution harness of claim 1, further including receptacle openings on said electrical receptacle, said jumper on a side of said electrical receptacle opposite said receptacle openings.

6. The distribution harness of claim 1, wherein said jumper includes a jumper terminal, at least one of said plurality of connector terminals includes a resilient arc, said jumper terminal is received in said resilient arc.

7. The distribution harness of claim 1, wherein said at least one jumper is a power infeed to said plurality of receptacle terminals.

8. The distribution harness of claim 1, wherein said jumper includes a jumper terminal, at least one of said plurality of receptacle terminals includes a resilient arc, said jumper terminal is received in said resilient arc.

9. The distribution harness of claim 1, wherein said jumper is removable from said electrical receptacle.

10. The distribution harness of claim 1, wherein said connector of said electrical receptacle includes said plurality of connector terminals at one end of said connector and is configured for connecting with a power infeed at an opposite end of said connector.

11. The distribution harness of claim 1, further including a plurality of three-prong power plug receptacle openings on said electrical receptacle, said at least one jumper being on a side of said electrical receptacle opposite said three-prong power plug receptacle openings.

12. The distribution harness of claim 1, wherein said electrical receptacle includes a single housing which at least partially encloses said plurality of receptacle terminals and said plurality of connector terminals.

* * * * *